US009056216B1

(12) United States Patent
Bouza

(10) Patent No.: US 9,056,216 B1
(45) Date of Patent: Jun. 16, 2015

(54) JUMP ROPE

(76) Inventor: Kevin Bouza, Metairie, LA (US)

( * ) Notice: Subject to any disclaimer, the term of this patent is extended or adjusted under 35 U.S.C. 154(b) by 172 days.

(21) Appl. No.: 13/564,898

(22) Filed: Aug. 2, 2012

Related U.S. Application Data

(60) Provisional application No. 61/514,093, filed on Aug. 2, 2011.

(51) Int. Cl.
*A63B 21/00* (2006.01)

(52) U.S. Cl.
CPC ..... *A63B 21/00* (2013.01)

(58) Field of Classification Search
USPC ..... 482/126, 121, 81, 82
See application file for complete search history.

(56) References Cited

U.S. PATENT DOCUMENTS

| | | | | | |
|---|---|---|---|---|---|
| 932,780 | A * | 8/1909 | Hero | 601/132 |
| 4,505,474 | A | 3/1985 | Mattox | |
| 4,919,417 | A * | 4/1990 | Poulas | 482/82 |
| 5,022,646 | A * | 6/1991 | Kessler | 482/82 |
| 5,054,772 | A * | 10/1991 | Winston | 482/82 |
| 8,043,196 | B1 * | 10/2011 | Chen | 482/82 |

* cited by examiner

*Primary Examiner* — Jerome W Donnelly
(74) *Attorney, Agent, or Firm* — Kenneth L Tolar

(57) ABSTRACT

A weighted jump rope includes an elongated cord having a first end, an opposing second end, an intermediate portion and an axial bore extending from an opening on the first end to an opening on the second end. The axial bore is filled with a predetermined amount of weighted material, such as sand. A dowel received within each opening forms an expanded portion that retains a bearing disc on each end of the cord. Each bearing disc engages an internal bearing surface within a rotating handle assembly that prevents the cord from binding or contorting as it encircles an exerciser.

13 Claims, 2 Drawing Sheets

JUMP ROPE

CROSS REFERENCE TO RELATED APPLICATIONS

This application is entitled to the benefit of provisional application No. 61/514,093 filed on Aug. 2, 2011, the specification of which is hereby incorporated by reference.

BACKGROUND OF THE INVENTION

The present invention relates to a weighted jump rope having a rotatable handle that prevents the rope from binding or contorting.

DESCRIPTION OF THE PRIOR ART

A myriad of weighted jump ropes exist in the prior art for intensifying an exercise regimen while simultaneously incorporating resistance training. The modified prior-art jump ropes typically include additional weights attached to the handles or mounted on the rope exterior. However, weighted handles exert only the wrist and hands while weights externally mounted on a rope can damage an underlying surface. Furthermore, the additional weight is typically concentrated in specific areas, resulting in resistance variations that minimize the effectiveness of an exercise routine.

At least one conventional jump rope, as disclosed in U.S. Pat. No. 4,505,474 issued to Mattox, is filled with sand to purportedly overcome the above-described disadvantages of other weighted jump ropes. However, the device of Mattox includes a fixed handle that causes the cord to bind and contort as it circles an exerciser.

Finally, although jump ropes with rotatable handles exist, most experience significant friction between the handle and rope, resulting in premature product failure. Likewise, frictionless, swiveling mechanisms found on certain traditional jump ropes would be incompatible with a sand-filled rope.

Accordingly, there is currently a need for a weighted jump rope that overcomes the above-described disadvantages of the prior art. The present invention addresses this need by providing a jump rope formed of a sand-filled cord having a rotatable handle at each of two ends to prevent binding and contorting. Furthermore, a uniquely-designed bearing assembly minimizes friction between the handle and cord to assure smooth rotation and to prevent premature product deterioration or failure.

SUMMARY OF THE INVENTION

A weighted jump rope includes an elongated cord having a first end, an opposing second end, an intermediate portion and an axial bore extending from an opening on the first end to an opening on the second end. The axial bore is filled with a predetermined amount of weighted material, such as sand. A dowel received within each opening creates an expanded portion that retains a bearing disc on each end of the cord. Each bearing disc engages an internal bearing surface within a rotating handle assembly that prevents the cord from binding or contorting as it encircles an exerciser.

It is therefore an object of the present invention to provide a weighted jump rope having a rotatable handle to prevent binding and contorting.

It is another object of the present invention to provide a jump rope having an improved bearing mechanism for a rotating handle that minimizes wear and produces a smoother rotation.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
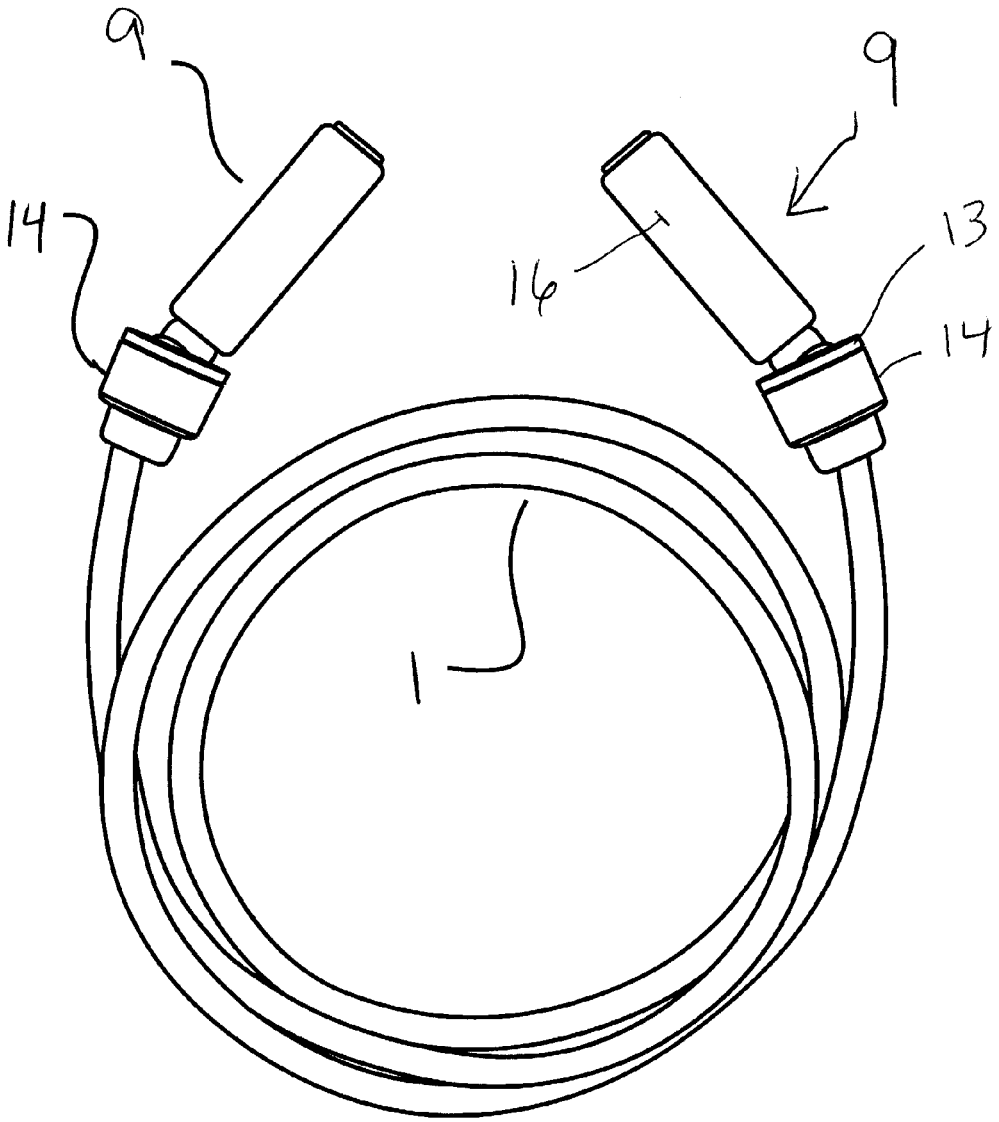
FIG. 1 is a plan view of the jump rope according to the present invention.
Figure 2:
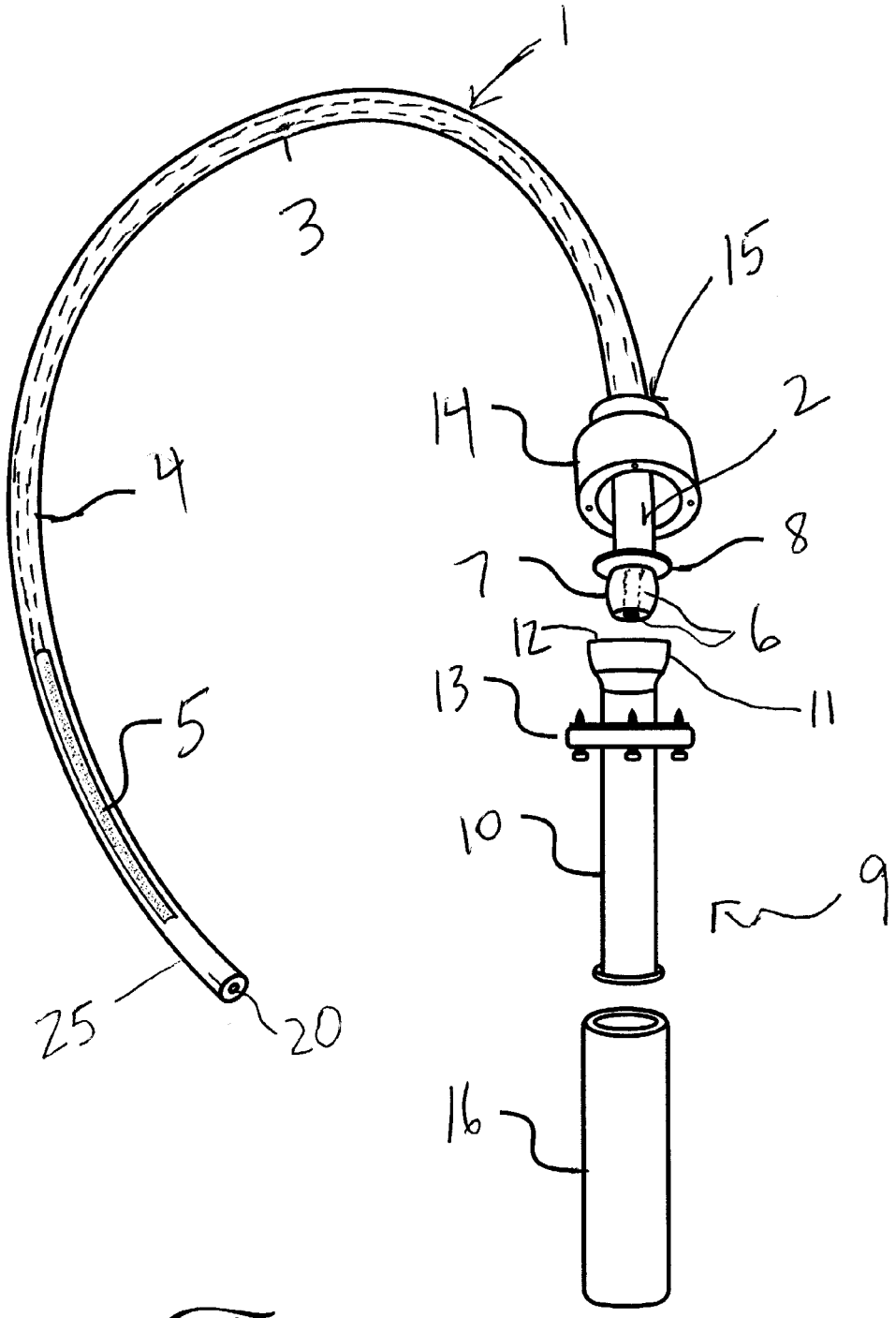
FIG. 2 is a cutaway view of the jump rope.

A weighted jump rope includes an elongated cord 1 having a first end 2, an opposing second end 25, an intermediate portion 3 and an axial bore 4 extending from an opening 20 on the first end to an opening 20 on the second end. The cord is preferably constructed with a semi-rigid rubber or a similar elastomeric material that stretches and contracts slightly when the rope is in use to vary the force applied to the user's hands and wrists. The axial bore is filled with a predetermined amount of weighted material, such as sand 5. The diameter of the bore and the thickness of the cord may be varied to accommodate less or additional sand to create a cord having a desired weight.

A dowel 6 is received within each opening 20 to form an expanded portion 7 that retains a bearing disc 8 on each end of the cord. The dowel 6 also hermetically seals each opening 20 to contain the sand within the bore.

Attached to each end of the cord is a rotating handle assembly 9 that allows the cord to repeatedly circle an exerciser's body without binding or contorting. The handle assembly 9 includes a tubular shell 10 having a flared, open end 11 that is defined by a continuous outer rim 12; the expanded portion 7 of the cord is received within the flared open end 11, and the bearing disc 8 engages the rim 12 to create a bearing surface that allows the shell to smoothly rotate relative to the cord.

An annular flange 13 mounted on the shell 10 attaches to a shroud 14 to enclose and protect the bearing disc 8, the expanded portion 7 and the dowel 6. Preferably, the shroud includes an upper opening 15 that is somewhat larger than the diameter of the cord to assure uninhibited rotation therebetween, and to allow varying-sized cords to be interchangeably used with a single handle assembly. A foam sleeve 16 encapsulates the shell to provide a more comfortable gripping surface for an exerciser.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An improved jump rope comprising:

an elongated, weighted cord having a first end, an opposing second end and an intermediate portion;

a first handle assembly rotatably attached to the first end of said cord;

a second handle assembly rotatably attached to the second end of said cord, said first handle assembly and said second handle assembly allowing said cord to repeatedly circle an exerciser's body without binding or contorting, wherein said first handle assembly and said second handle assembly each include a tubular shell having a flared, open end that is defined by a continuous outer rim, a bearing disc attached to either of said first end of said cord and said second end of said cord, said bearing disc engaging said outer rim to create a bearing mechanism that allows said shell to smoothly rotate relative to said cord.

2. The jump rope according to claim 1 wherein said cord further comprises a bore filled with a predetermined amount of weighted material.

3. The jump rope according to claim 1 wherein said cord is constructed with an elastomeric material that stretches and contracts slightly when the cord is manipulated to vary a force applied to an exerciser's hands and wrists.

4. The jump rope according to claim 1 further comprising:

a dowel received within an opening on either of the first end and the second end of said rope, said dowel forming an expanded portion on said cord to retain said bearing disc thereon.

5. The jump rope according to claim 1 further comprising:

an annular flange surrounding said shell;

a shroud attached to said flange and enclosing said bearing disc.

6. The jump rope according to claim 5 wherein said shroud includes an upper opening that receives said cord, said upper opening having a diameter that is larger than a diameter of said cord to assure uninhibited rotation therebetween, and to allow varying-sized cords to be interchangeably used with said handle assembly.

7. An improved jump rope comprising:

an elongated cord having a first end, an opposing second end and an intermediate portion;

means for weighting said cord to intensify an exercise routine, wherein said means for weighting said cord to intensify an exercise routine includes a bore formed within said cord, said bore filled with a predetermined amount of weighted material;

a handle assembly rotatably attached to the first end and the second end of said cord that allows the cord to repeatedly circle an exerciser's body without binding or contorting;

a first bearing disc attached to the first end of said cord;

a second bearing disc attached to the second end of said cord, said first bearing disc and said second bearing disc providing a bearing surface against which said handle assembly smoothly rotates.

8. The jump rope according to claim 7 wherein said cord is constructed with an elastomeric material that stretches and contracts slightly when the cord is manipulated to vary a force applied to an exerciser's hands and wrists.

9. The jump rope according to claim 7 further comprising:

a first dowel received within a first opening on the first end of said rope;

a second dowel received within a second opening on the second end of said rope, said first dowel and said second dowel forming an expanded portion on said cord to retain said first bearing disc and said second bearing disc thereon.

10. The jump rope according to claim 7 wherein said handle assembly includes a tubular shell having a flared, open end that is defined by a continuous outer rim, said outer rim engaging either of said first bearing disc and said second bearing disc to create a bearing mechanism that allows the shell to smoothly rotate relative to the cord.

11. The jump rope according to claim 10 further comprising:

an annular flange surrounding said shell;

a shroud attached to said flange and enclosing either of said first bearing disc and said second bearing disc.

12. The jump rope according to claim 11 wherein said shroud includes an upper opening that receives said cord, said upper opening having a diameter that is larger than a diameter of said cord to assure uninhibited rotation therebetween, and to allow varying-sized cords to be interchangeably used with said handle assembly.

13. The jump rope according to claim 10 further comprising a foam sleeve encapsulating said shell to provide a comfortable gripping surface for an exerciser.

* * * * *